United States Patent [19]

Dexter, Jr.

[11] Patent Number: 4,964,496

[45] **Date of Patent: * Oct. 23, 1990**

[54] MASS TRANSIT SYSTEM

[76] Inventor: Fred F. Dexter, Jr., 2311 S. Blvd., Houston, Tex. 77098

[ * ] Notice: The portion of the term of this patent subsequent to May 9, 2006 has been disclaimed.

[21] Appl. No.: 453,577

[22] Filed: Dec. 20, 1989

Related U.S. Application Data

[63] Continuation-in-part of Ser. No. 330,857, Mar. 31, 1989, abandoned, which is a continuation-in-part of Ser. No. 893,741, Aug. 6, 1986, Pat. No. 4,828,099, which is a continuation-in-part of Ser. No. 661,427, Oct. 6, 1984, abandoned.

[51] Int. Cl.[5] ..... B65G 15/00

[52] U.S. Cl. ..... 198/324; 104/21; 104/25

[58] Field of Search ..... 198/321, 324, 328, 778; 104/20, 21, 25

[56] References Cited

U.S. PATENT DOCUMENTS

| | | | |
|---|---|---|---|
| 474,657 | 5/1892 | Hollingsworth | 104/21 |
| 780,268 | 1/1905 | Curtiss | 104/21 |
| 786,117 | 3/1905 | Hagen | 104/25 |
| 807,565 | 12/1905 | Lokillard | 198/321 |
| 896,098 | 8/1908 | Gale | 198/324 |
| 1,437,550 | 12/1922 | Putnam | 104/25 |
| 1,597,959 | 8/1926 | Edwards | 104/21 |
| 3,339,494 | 9/1967 | Lauber | 104/21 |
| 3,727,558 | 4/1973 | Winkle | 104/21 |
| 3,865,039 | 2/1975 | Cushman | 104/25 |
| 4,828,099 | 5/1989 | Dexter | 104/25 |

*Primary Examiner*—Joseph E. Valenza
*Attorney, Agent, or Firm*—Michael P. Breston

[57] ABSTRACT

The mass transit system comprises at least two train stations. Each station has at least one revolving platform whose upper surface defines a curvilinear track. Stationary tracks are positioned between the platforms. An endless flexible member is driven by the revolving platforms at a constant speed. The flexible member carries cars which together form an endless train. The cars are driven by the flexible member and ride over the stationary tracks and over the curvilinear tracks.

12 Claims, 7 Drawing Sheets

MASS TRANSIT SYSTEM

This application is a continuation-in-part of application Ser. No. 07/330,857 filed Mar. 31, 1989 now abandoned, which is a continuation-in-part of application Ser. No. 06/893,741 filed Aug. 6, 1986 and now U.S. Pat. No. 4,828,099, which is a continuation-in-part of application Ser. No. 06/661,427 filed 10/16/1984 and now abandoned.

BACKGROUND OF THE INVENTION

1. Field Of The Invention

This invention relates to a mass transit system which can carry persons, goods and/or materials from one train station to another, and which is especially adapted to serve as a people mover that allows, at any time, access to a continuously moving train of small cars inside each station. The endless train moves non-stop at a constant speed through the stations.

2. Description Of The Prior Art

Existing, discontinuous transport systems of public conveyance, such as railroad trains, streetcars, monorails, subways, automobiles, etc., provide a mode of transportation which is characterized by "stop-and-go" displacements that use up a substantial portion of the total travel time, and that are very expensive to operate.

Conventional intermittent-transport systems and continuous transport systems are described, for example, in the following U.S. patents:

474,657,
780,268,
786,117,
807,565,
896,098,
1,437,550,
1,597,959,
3,727,558,
3,865,039.

U.S. Pat. No. 3,865,041 to Bacon shows boats which are detached from each other and are propelled by a rotatable platform at a passenger loading station but elsewhere they move independently of each other and are self propelled. His single passenger loading station comprises a platform which is rotatable about a fixed axis and has a driving convex cylindrical wall around its outside circumferential edge which is covered with a rubber bumper. A waterway loops around a portion of this convex wall, and has straight portions leading away from and toward the circular platform. The boats are forcibly urged into frictional engagement with the rotating platform by an outer circular wall 45. When so pushed against the platform, the boats and the platform's outer circumferential edge will move with zero relative linear velocity therebetween. To avoid the need for such an outer wall 45 as in Bacon, it has been suggested to utilize sprocket type drives, which are cumbersome, bulky and heavy. They employ too many moving and complex parts and therefore are too expensive to manufacture and maintain. But, the chief problem with them lies in the fact that the sprockets stretch and as a result require complex synchronizing systems for obtaining true zero relative velocity between the rotatable platform and the endless train.

In accordance with said applicant's U.S. Pat. No. 4,828,099, the propulsion of a chain of very small cars is automatically synchronized with the propulsion of at least two revolving platforms, so that there is no relative velocity therebetween.

This is accomplished without any outside agencies, such as electronic speed synchronizing networks, or an outer wall such as that of Bacon and without drive sprockets. The chain of very small cars are hingedly-connected and form an endless tensioned train. Pivot means are provided for hingedly connecting the cars. The pivot axes of the pivot means are proximate the inner concave walls of the sleds. Each car is driven exclusively by frictional forces developed between the driving platform and the cars. These frictional forces result from direct mechanical engagement between the cars and the platforms when the cars are at the stations. The generated platform-to-car forces are primarily normal with resulting shear driving forces developed between each car and the platform. Reliance is had exclusively on tension within the endless train to generate the transfer of propulsion energy from the revolving platforms to the train.

SUMMARY OF THE INVENTION

The mass transit system comprises at least two train stations. Each station has at least one revolving platform whose upper surface defines a circular track. Stationary tracks are positioned between the platforms. An endless flexible member is driven by the revolving platforms at a constant speed. The flexible member drives the cars which together form an endless train. The cars ride over the stationary tracks and over portions of the circular tracks.

Preferably, the endless flexible member is maintained under tension and frictionally driven by the cylindrical outer walls of the revolving platforms. Each car has a light weight deck which supports a seat that accommodates one or more persons. Each car deck rides on the stationary tracks between the platforms and, upon entering each station, each deck is transferred to and rides over a portion of the curvilinear track.

BRIEF DESCRIPTION OF THE DRAWINGS

FIG. 3*a* is a side elevational view of a portion of a modified flexible member;

DETAILED DESCRIPTION OF PREFERRED EMBODIMENTS

Figure 1:
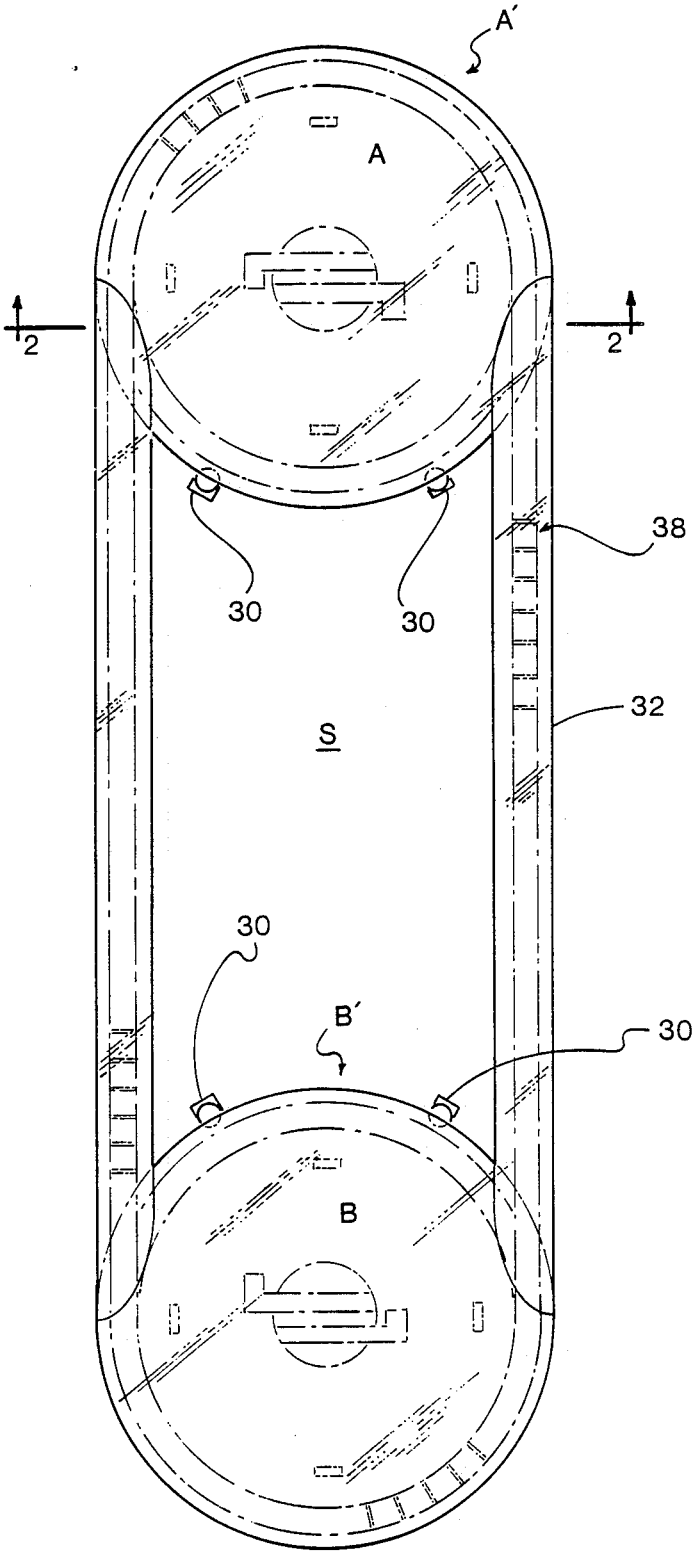
FIG. 1 is a top view of one embodiment of the the novel mass transit system showing two train stations that are equally spaced from the ground.

In FIGS. 1–5 is shown one embodiment of the novel mass transit system, generally designated as S (FIG. 1), which is adapted for moving passengers at fairs, exhibits, airports, and over short or long distances. System S has at least two train stations A′ and B′ which can be above, below or at ground level and which can have identical revolving platforms A and B, respectively. System S can be well integrated with existing moving walkways and ramps so as to minimize the walking distances for passengers to and from train stations A′ and B′.

For an above ground system S, a pillar base 42 (FIG. 2) supports a flat, stationary, circular deck 44. Platform A is mounted on rotatable support wheels 10 which can be idle or driven.

An axle 11 supports wheel 10 which can be a rubber-tire that makes frictional contact with the undersurface of revolving platform A through an opening 46 (FIG. 4) in deck 44.

A pair of stationary tracks means, generally designated as 26 (FIGS. 1 and 3), are positioned between revolving platforms A and B. Each stationary track means 26 can be a hollow member having a rectangular sectional area with a smooth top surface 26*a*, which can be teflon coated to minimize friction.

Revolving platform A (FIGS. 1–2, 5) has a center hole 12, which is concentric with a center hole 45 in deck 44, an outer circular edge 14, a cylindrical outer wall 16, and an upper surface 22, which can be flat or preferably dish-shaped. A flat circular track 48 is defined between a shoulder 23 and the top outer circular edge 14 of revolving platform A.

A rotating shaft 28 (FIG. 4) carries a wheel 30 which continuously drives outer wall 16 of revolving platform A. At least two such spaced-apart driven wheels 30 propel outer wall 16 in the same direction and at exactly the same speed. Shafts 28 can be rotated by synchronized electric or hydraulic motors (not shown).

One or more stationary or moving escalators 18 (FIG. 2) move passengers through center hole 12 between a lower level 20 and upper surface 22 of revolving platform A.

An endless flexible member, generally designated as 24 (FIG. 3), which can be a cable 24*a* or a belt 24*b*, rides in a circular groove 50 (FIG. 5) in outer wall 16 of revolving platform A. Wheels 30 push platform A against cable 24*a* to allow outer walls 16 and flexible member 24 to establish and maintain therebetween a strong engagement, thereby frictionally driving cable 24*a* or belt 24*b*.

The required tension in flexible member 24 is maintained within prescribed deviation limits from a correct tension reference set by the train operator. This tension must be sufficient to permit the development of the required frictional shear driving forces between flexible member 24 and an arcuate portion of outer walls 16 of revolving platforms A and B. It will be appreciated that each cylindrical outer wall 16 is at the same time a driven wall propelled by wheels 30, and a driving wall propelling cable 24*a*.

Flexible member 24 carries therealong spaced-apart, cars, generally indicated as 36 (FIG. 3), each sufficiently small to accommodate only one or two passengers.

Flexible member 24 together with cars 36 form an endless passenger train, generally designated as 38, that is driven in a closed loop circuit by revolving platforms A and B.

Each rotary platform thus acts as a giant sheave for driving flexible member 24 which in turn propels cars 36 in a synchronized manner to ensure the safety of the passengers.

Figure 2:
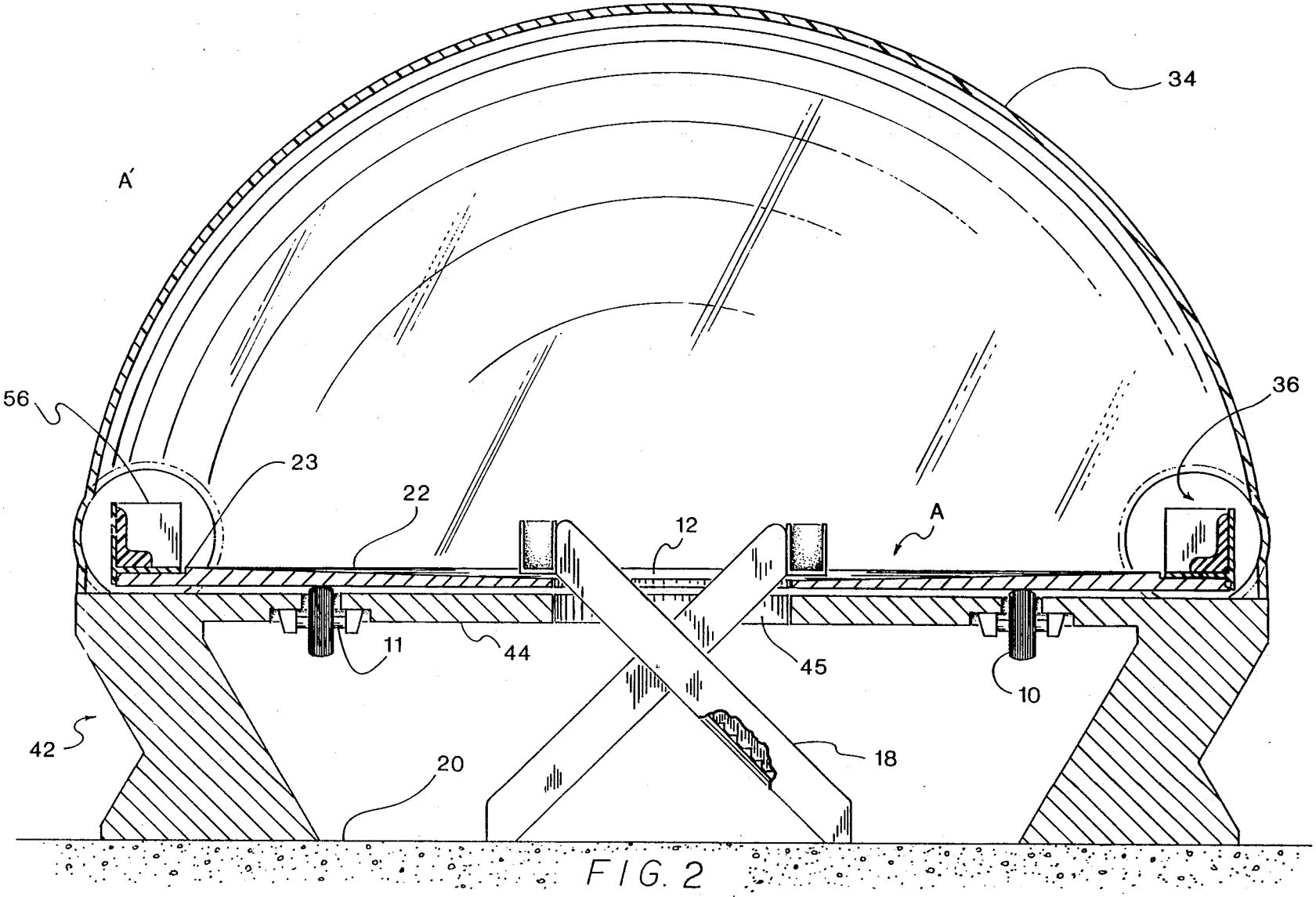
FIG. 2 is a vertical, sectional view of a single train station taken along line 2—2 on FIG. 1.

Each car 36 has side walls 56 and a flat, light-weight deck 40 which has a smooth, inner concave wall 37 (FIG.3) that matches appositional convex shoulder 23 of curvilinear track 48 (FIG. 2). Rear wall 55 of car 36 has a downwardly-projecting lip 58 which can be welded or detachably coupled to cable 24*a* or to belt 24*b*. There is installed longitudinally on car deck 40 a bench 52 which has a cushioned back 54 and serves as a support and retainer for a forwardly-accelerated passenger.

Figures 3, 5:
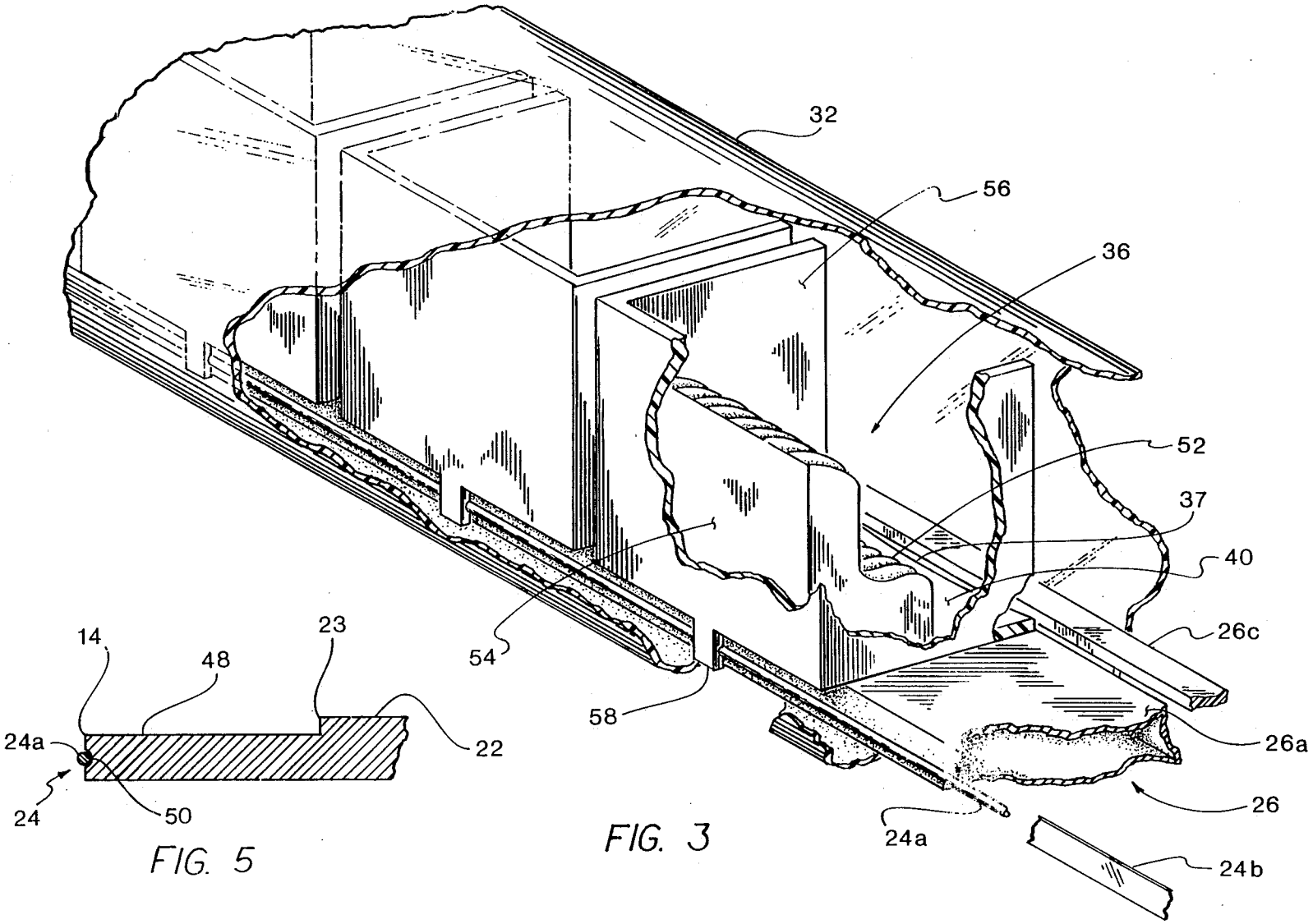
FIG. 3 is a perspective elevational view of a portion of the pipeline, the stationary track, and of the train therein.
FIG. 5 is an enlarged fragmentary sectional view of the revolving platform taken on line 5—5 on FIG. 4.
Figure 4:
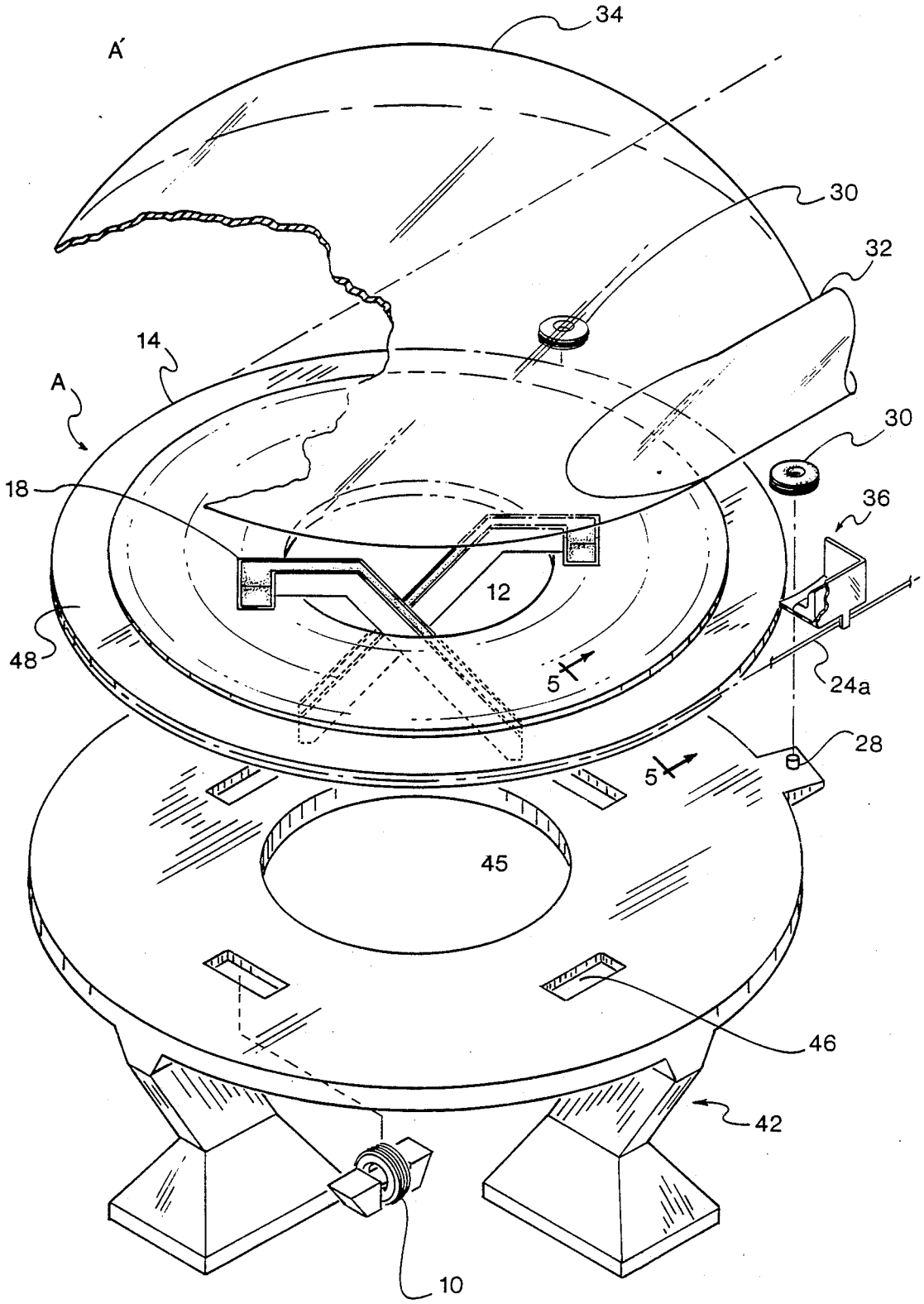
FIG. 4 is an exploded view of the major parts of a typical train station shown in FIG. 2.

Car decks 40 slide with minimum friction on smooth top surfaces 26*a* of stationary tracks or rails 26 and on arcuate track 48 (FIG. 5).

A continuous ledge 26*c* (FIG. 3) is positioned in front of car decks 40 and along the entire length of stationary track 26.

The stationary rail 26 and ledge 26*c* are disposed at the bottom of a pipeline, generally designated as 32, which may be supported by spaced towers over sidewalks, esplanades, freeway medians, etc.

As described in my said U.S. Pat. No. 4,828,099, for an above ground system S, each train station A′ or B′ comprises a dome-shaped roof 34 (FIGS. 2, 4) together with two transparent pipeline sections 32. The transparency will take full advantage of sunlight, moonlight and street light.

Inside the transparent pipelines, air is entrained by friction between cars 36 and the surrounding air, due to, what is described in mechanics textbooks, as Couette Flow. The clearances between cars 36, seats 52, and the pipeline's inner wall are selected so that a proper ratio of train speed to air speed becomes established. It is desired for the air to have near zero relative velocity with train 38 in order to avoid passenger discomfort, blown hair, etc.

Dome-shaped roof 34 protects revolving platform A from the weather and allows forced air circulation within pipeline 32 at the same or slightly higher velocity as that of train 38. Roof 34 smoothly guides the air stream emerging from approaching pipeline 32 around the curve of track 48 and into train station A′, thence into exiting pipeline 32 and into train station B′, all of which causes the air stream to move in a closed circuit in the direction of train 38. This air stream adds to the comfort of the riding passengers. Also, train 38 will encounter inside pipelines 32 less friction from air resistance and, hence, will consume less propulsion energy.

Platforms A and B revolve in the same direction about their center axes and their diameters are determined by the desired velocity for train 38. All cars 36 move at the same linear velocity which is automatically and precisely synchronized with the speed of revolving platforms A and B.

When a car deck 40 reaches revolving platform A, it rides over a portion of flat circular track 48 (FIG. 5) on the revolving platform's upper surface 22 and it moves therewith and at the same angular velocity.

In use, each boarding passenger will step down from escalator 18 onto top surface 22 of rotating platform A at a point close to the center thereof. At that point, the linear velocity is relatively small.

The passenger will continue to move outwardly in a radial direction across top surface 22. In so doing, he will gradually become accelerated until he reaches shoulder 23. Because train 38 is endless, the passenger can board immediately an arriving empty car 36. The boarding is greatly facilitated by the fact that bench 52 is longitudinally mounted on car deck 40 and that there is no relative velocity between arcuate edge 37 thereof and shoulder 23 on revolving platform A.

Conversely, each arriving passenger will step down from car deck 40 onto rotating platform A at appoint relatively remote from the center thereof. At that point, the linear velocity is relatively high. But, because there is no speed difference between shoulder 23 and the outer edge 37 of car deck 40, a passenger can alight from car 36 onto revolving platform A with comfort, safety, and without irritation, as if they were stationary. He then moves inwardly in a radial direction toward center hole 12 of revolving platform A, and thus becomes gradually decelerated from the velocity of train 38 to a very low velocity at a point which is near to escalator 18. Also, since train 38 continuously moves at a constant velocity, there will be no inefficient use of propulsion energy, and no irritating jerks for a passenger reading a newspaper in complete comfort.

In the modified transport system, generally designated as S' (FIGS. 6–9), the same reference characters will be used to designate the same or similar parts as in system S (FIGS. 1–5), while the modified parts will be designated with 3-digits, the last 2-digits being the same as in FIGS. 1–5 to indicate similarity of construction and/or function.

Figure 7:
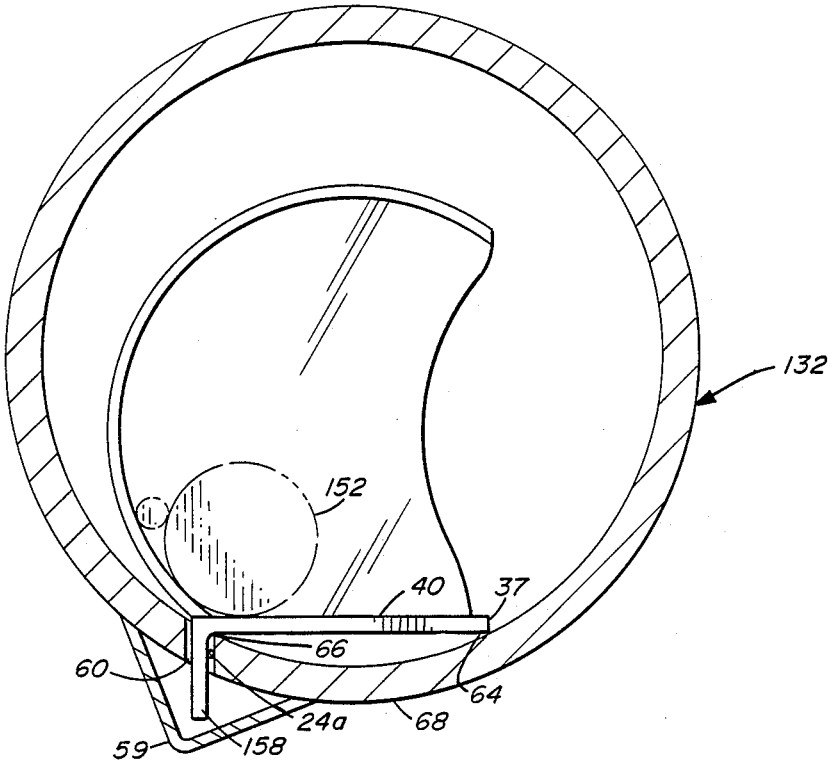
FIG. 7 is a vertical, sectional view of a modified pipeline and of the modified car riding therein.
Figure 6:
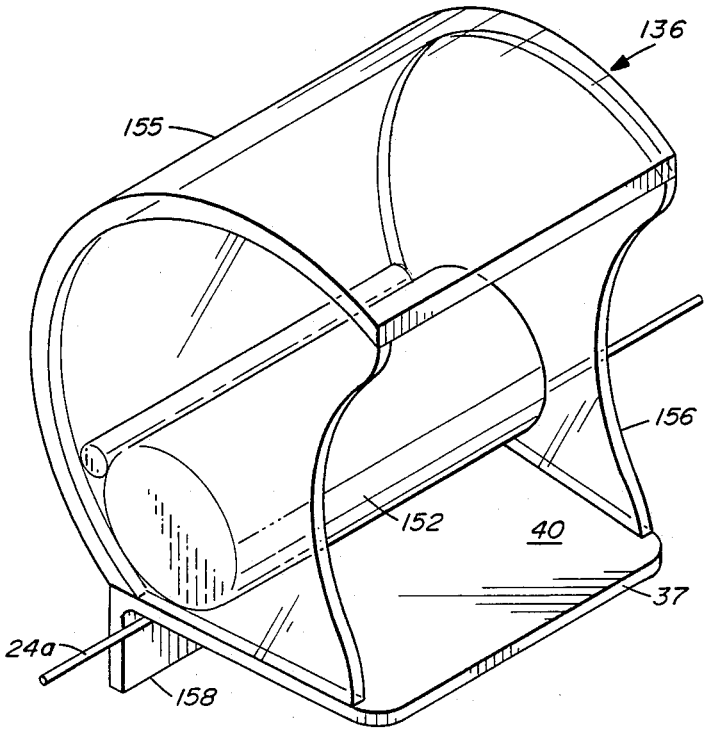
FIG. 6 is a perspective elevational view of a modified car.

In FIG. 6 is shown a perspective view of a modified car generally designated as 136. FIG. 7 shows a vertical, sectional view of a modified pipeline section 132 and of the modified car 136 therein.

Each pipeline 132 preferably has a circular section and a longitudinal slit 60 extending all along the bottom of the pipeline.

Each modified car 136 has transparent side walls 156, a rear transparent curved wall 155, and a small rectangular, substantially flat, light-weight car deck 40 whose outer longitudinal concave wall 37 is shaped to match appositional convex shoulder 23 at the inner edge of curvilinear track 48 (FIG. 2). Desirably, deck 40 is sufficiently small to accommodate only a single passenger. A suitable cylindrical bench 152 is installed longitudinally at the rear of deck 40.

A keel 158 downwardly-projects from the longitudinal inner end of deck 40. Each keel 158 is welded or detachably coupled to flexible cable **24*a*. Each keel 158 passes through and projects outwardly from slit 60 in pipeline 132. The function of slit 60 is to keep and maintain all cars 136** in proper alignment within the pipeline.

Since the portion of the pipeline underneath deck 40 is concave, only the outer and inner longitudinal edges 64, 66 thereof contact and ride over the pipeline, while keel 158 rides inside longitudinal slit 60.

Figure 8:
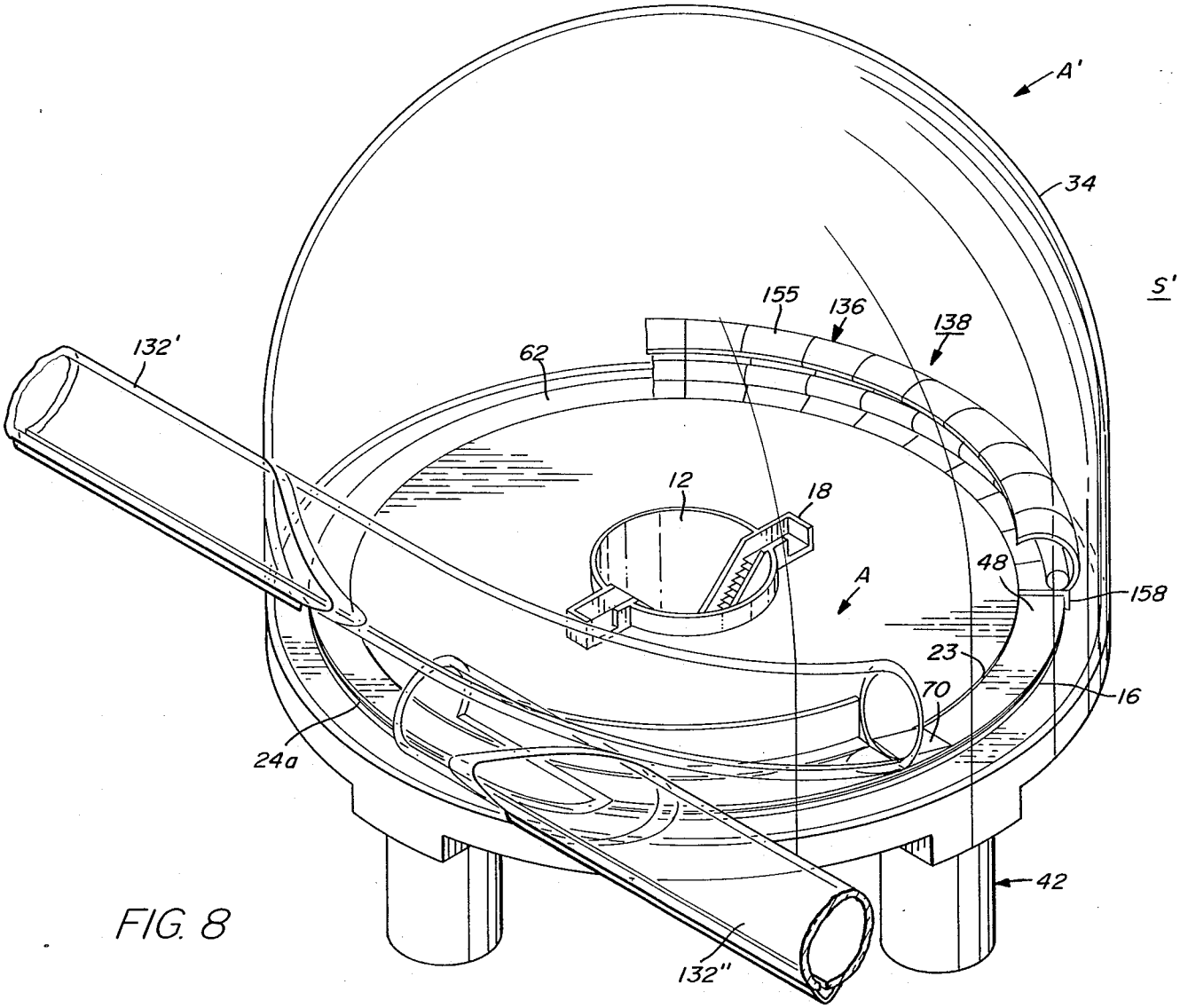
FIG. 8 is a perspective elevational view of a single train station integrated with an incoming modified pipeline section and with an outgoing modified pipeline section, wherein both pipeline section follow substantially the same direction.
Figure 9:
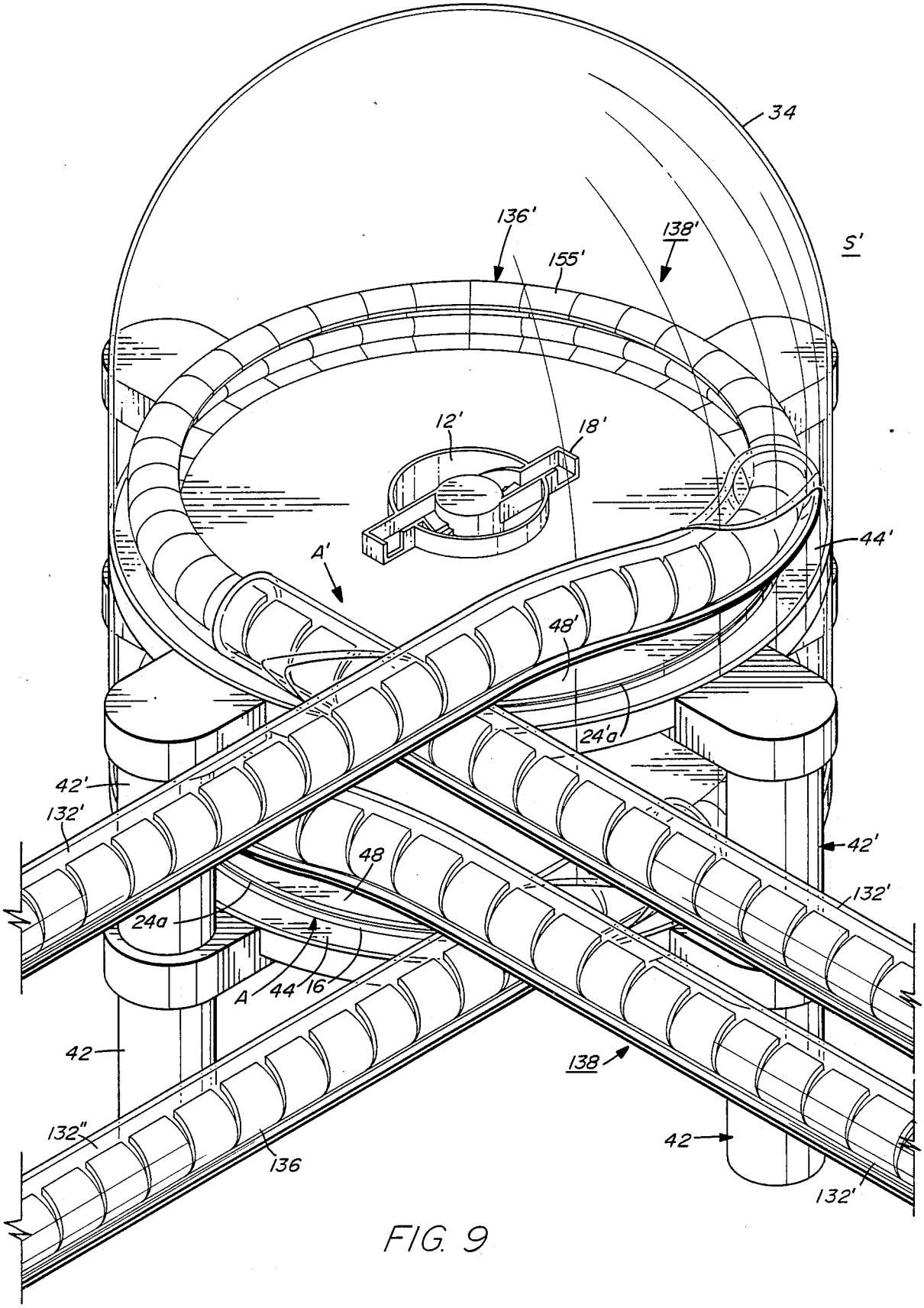
FIG. 9 is a perspective elevational view of a single train station similar to FIG. 8 but showing two vertically-stacked revolving platforms, and wherein the incoming and outgoing pipeline sections intersect and follow different directions.

The modified cars 136 are spaced apart and together with cable **24*a* form an endless passenger train 138 (FIGS. 8–9**).

A single train station A' can be integrated with incoming and outgoing pipeline sections 132 (FIG. 8), both of which can follow substantially the same direction or follow different directions, as shown in (FIG. 9).

FIG. 9 shows a perspective elevational view of a single train station having two vertically-stacked revolving platforms A, each integrated with two transparent pipeline sections 132.

To allow for the pipeline sections 132 to cross over, a corkscrew track 62 is provided on each revolving platform A. Track 62 allows an arriving train 138 to make a complete circle or portion thereof around the platform and exit into an outgoing pipeline section 132'' which is positioned below the incoming pipeline section 132'.

The car decks 40 will slide consecutively over a wedge-shaped transitional member 70 and smoothly engage track 26.

In this manner, train 138 can arrive at one angle relative to the center axis of the revolving platform A and exit at another angle after making a least a 180° turn around the outer wall 16 of revolving platform A (FIG. 8).

This outer wall 16 and flexible cable **24*a* establish and maintain therebetween a strong, frictional engagement. The tension in cable 24*a* is sufficient to permit the development of the required frictional driving forces between cable 24*a* and outer wall 16**.

Revolving platform A thus acts as a giant sheave for directly propelling successively approaching portions of cable **24*a*, and for indirectly propelling successively approaching cars 136. This positive and indirect drive ensures safe passenger boarding into cars 136** and stepping out therefrom.

In use, an arriving train 138 smoothly leaves one pipeline section 132 and rides over a portion of spiral track 62 on the revolving platform's upper surface and it moves therewith and at the same angular speed. The arrangement in FIG. 9 allows a passenger to transfer from one train to another.

The cost of constructing and operating system S or S' will be a fraction of the cost involved in constructing either a conventional, intermittent-transport system, or any one of the continuous transport systems that were already proposed in the prior art.

The novel mass transit system S or S' is energy efficient, light weight, compact, modular, easy to fabricate and to repair. It lends itself to mass modular construction techniques, and it can be easily incorporated into existing structural buildings without appreciably affecting their utility. It moves passengers conveniently, comfortably, and safely.

Elevated mass-transit system S or S' can make optimum and efficient use of established right-of-ways, without requiring substantial modifications thereto, thereby minimizing the need to acquire new and very costly right-of ways.

What I claim is:

1. A mass transit system, comprising:

at least two train stations, each having at least one platform revolving about its center;

each revolving platform having a curvilinear track, a center hole, a curvilinear outer edge, and a cylindrical outer wall;

said curvilinear track extending radially inwardly from said curvilinear outer edge;

stationary track means positioned between said platforms;

an endless flexible member driven by said revolving platforms at a substantially constant speed and being maintained under tension around said cylindrical outer walls of said revolving platforms so as to have substantially zero velocity relative to said outer walls of said revolving platforms;

a plurality of cars carried by said flexible member, and said cars together forming an endless train driven by said flexible member at said substantially constant speed; and said train riding over said stationary track means and over said curvilinear tracks on said platforms.

2. A mass transit system according to claim 1, wherein each car has a deck which in its trajectory rides over said stationary tracks means and over said curvilinear tracks.

3. A mass transit system according to claim 2, wherein said stationary track means includes a pipeline.

4. A mass transit system according to claim 2, wherein said stationary track means includes a pipeline and a rail on the bottom of said pipeline; and said car decks ride over said rail.

5. A mass transit system according to claim 2, wherein said stationary track means includes a pipeline having a longitudinal slit extending all along the bottom thereof;

a keel projects downwardly from each car deck and extends through said slit; and each keel is secured to said flexible member.

6. A mass transit system comprising:

at least two stations, each station including a circular platform revolvable about its center axis, said platform having an entrance hole concentric with said axis, an upper surface, a lower surface, an outer curvilinear edge, and a circumferential outer wall;

propulsion means for continuously revolving each platform at a predetermined angular velocity;

a tensioned, endless, flexible member frictionally engaging consecutive portions of said outer walls of said platforms when in contact therewith;

a plurality of cars carried by said flexible member to form therewith an endless train moving at an angular velocity through said stations which is substantially equal to said angular velocity of said revolving platforms;

stationary track means between said revolving platforms;

each car riding over said stationary track means and over the upper surface of said revolving platforms; and said revolving platforms permitting passenger ingress to and egress from each car during a condition of zero relative motion between said revolving platforms and said cars on said flexible member.

7. A mass transit system according to claim 6, wherein said upper surface of said revolving platform defines a curvilinear track extending radially inwardly from said curvilinear outer edge; and each car has a deck which rides over said stationary tracks means and over said curvilinear tracks.

8. A mass transit system according to claim 7, wherein said stationary track means includes a pipeline.

9. A mass transit system according to claim 7, wherein said stationary track means includes a pipeline and a rail on the bottom of said pipeline; and said car deck rides over said rail.

10. A mass transit system according to claim 7, wherein said stationary track means includes a pipeline having a longitudinal slit extending all along the bottom of said pipeline;

a keel extends downwardly from each car deck and is secured to said flexible member; and said keel rides within said slit.

11. A mass transit system according to claim 10, wherein each car deck rides over said pipeline and over said curvilinear track on said revolving platform.

12. The transit system according to claim 6, wherein said pipeline has a longitudinal slit all along the bottom thereof;

each car has a deck and a keel extending downwardly therefrom;

said keel is fixedly attached to said flexible member;

said car deck rides over said pipeline; and said keel rides within said slit.

* * * * *